United States Patent [19]

Hayden

[11] 4,330,894

[45] May 25, 1982

[54] METHOD OF OPENING METAL BEVERAGE CONTAINERS

[76] Inventor: Robert K. Hayden, P.O. Box 488, La Plata, Md. 20645

[21] Appl. No.: 109,869

[22] Filed: Jan. 7, 1980

[51] Int. Cl.[3] ..... B25F 1/00

[52] U.S. Cl. ..... 7/152; 7/156; 81/3.47

[58] Field of Search ..... 81/1 R, 177 C, 3.47; 7/152, 156

[56] References Cited

U.S. PATENT DOCUMENTS

| | | | |
|---|---|---|---|
| 888,580 | 5/1908 | Brinn | 81/177 C X |
| 1,000,226 | 8/1911 | Arwine | 81/177 C UX |
| 2,543,283 | 2/1951 | Frank | 81/1 R |
| 2,548,517 | 4/1951 | Clark | 7/152 X |
| 2,788,817 | 4/1957 | Leniz | 81/177 C X |
| 3,495,284 | 2/1970 | Weingarot | 7/152 |
| 4,213,215 | 7/1980 | Hall | 81/3.47 X |

*Primary Examiner*—James G. Smith
*Attorney, Agent, or Firm*—Frank P. Cyr

[57] ABSTRACT

A finger or thumb worn thimble provided at one end thereof with a blade which can be used to puncture the end of a metal container and which is also provided with a cutting edge adjacent the aforesaid blade which can be used for cutting twine, rope, etc.

2 Claims, 3 Drawing Figures

METHOD OF OPENING METAL BEVERAGE CONTAINERS

BACKGROUND OF THE INVENTION

A number of metal containers are now provided with an opening tab at one end of the container which can be lifted from a generally horizontally extending position to an upright position in order to effect an uncovering of an exit opening in the container thus permitting the contents of the container to be expelled therefrom. Usually, such tabs must be grasped by one's finger to exert an upward pull on the tab with eventual fracture of a line of weakness in the container closure to thus form an exit opening in the container. Oftentimes, one must grasp the tab with one's fingernails in order to raise the tab from it's initial horizontally extending position to a more or less vertically extending position during the fracture of the weakened line extending about the area which is to form the exit opening for the container. As can be appreciated, grasping the tab with one's fingernails will often result in breaking of the fingernails and this is to be avoided if possible.

Thus, with the above in mind, it is one object of the invention to provide a thimble-like appliance which can be slipped over the finger or thumb of the user thereof which will permit the user thereof to safely engage the tab of a rupturable exit opening without danger of breaking one's fingernails.

Another object of the invention is to provide a thimble-like appliance which can be applied to the finger or thumb of the user thereof and which will be equipped with a generally triangularly shaped cutting blade which can be used to form an opening in a container which does not have an easy opening tab at one end of the container.

Another object of the invention is to provide a sharpened projection adjacent the triangularly shaped cutting blade which can be used for cutting twine, rope, or the like.

Other objects and advantages of the invention will appear as the following description of a preferred and practical embodiment thereof proceeds.

DESCRIPTION OF THE PREFERRED EMBODIMENTS

Figure 1:
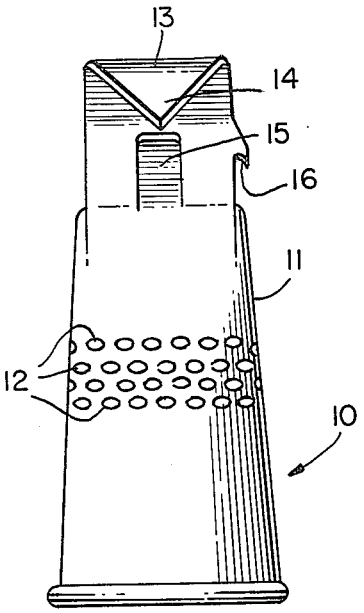
FIG. 1 is a perspective view of the finger or thumb attachment of the present invention.
Figure 2:
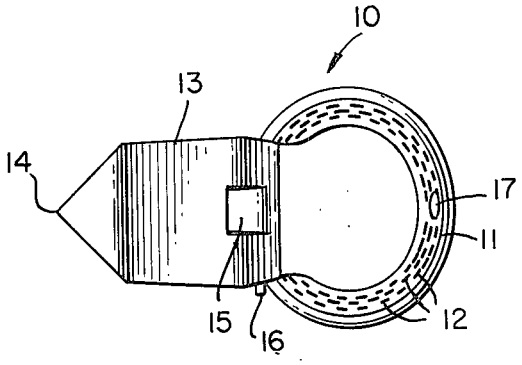
FIG. 2 is a top plan view of FIG. 1 of the drawings, and, FIG. 3 is a side elevation of the structure shown in FIG. 1 of the drawings.

Referring now to the drawings wherein like reference numerals are employed to designate like parts throughout the several views thereof, numeral 10 designates in general, the finger or thumb worn attachment of the present invention. The attachment comprises a generally cylindrical and tapered formation made of a size to comfortably fit over one's finger or thumb when in use. The attachment which will now be referred to as a thimble includes a finger or thumb encircling area designated at 11 and which is preferably made of a soft metal such as aluminum or the like. The employment of a relatively soft metal in the formation of this part of the thimble will enable the user thereof to squeeze or bend the material so as to ensure a fit of the thimble around the finger or thumb of the user.

Figure 3:
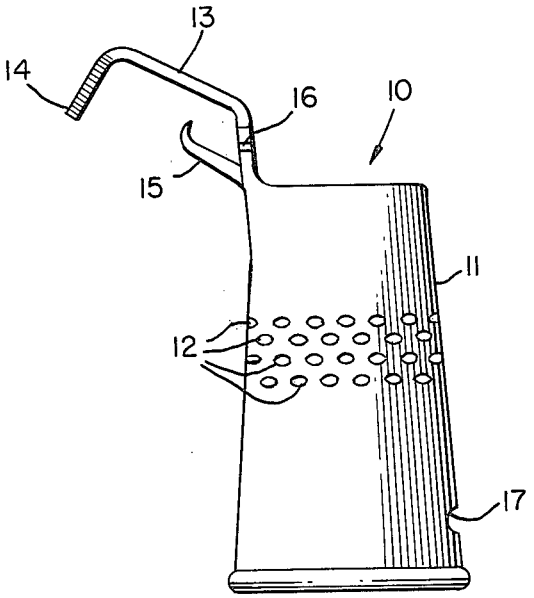

A number of perforations 12 are formed along the wall of the thimble so as to provide a circulation of air about the member to which the attachment is applied. A generally triangularly shaped blade 13 constructed of a hard or tempered metal is secured in any manner as by welding, brazing or the like to the upper portion of the main body of the encircling area 11. The blade 13 is provided with a pointed and sharpened end 14 which is conventional and such is shown in prior U.S. Pat. No. 4,213,215. The blade 13 extends upwardly and outwardly of the number encircling area such as shown in FIG. 3 of the drawing and terminates in a downwardly and also slanted portion to the point of the blade as shown at 14 in FIG. 3 of the drawings.

Formed as a part of the blade 13 and constructed of the same hardened metal is a spur 15 which is employed to engage the rim of a container when the attachment is employed to form an exit opening in one end of a container which is not provided with a pull tab-type opener.

A projection 16 extends from the blade 13 and the same may be sharpened so that the user of the thimble may employ the same to cut twine, cord, etc.

An opening 17 is formed in the body of the member encircling member 11 so that when the attachment is not in use or not mounted on the finger or thumb of the user thereof, the same may be either hung from the neck of the user or secured to some garment of the user by means of a string or other fastening means extending through the aforesaid opening 17.

While I have described the above thimble as being particularly suitable for forming openings in a container or to use the same to pry off the lift tab of a container having a lift tab type opener, it is obvious the same may be employed for many other uses. For instance, the blade 13 may be conveniently employed for scoring cartons, cutting paper products and the like. However, the main purpose for providing a thimble-like attachment such as described above is to permit one to slip the thimble over one's finger or thumb to perform the above described operations without breaking one's finger or thumb nail.

While I have in the above description disclosed what I believe to be a preferred and practical embodiment of the invention, it will be understood by those skilled in the art that the details of construction and arrangement of parts as shown and described, are by way of example and not to be construed as limiting the scope of the invention.

I claim:

1. An attachment for a finger or thumb of the user thereof, said attachment comprising a generally cylindrical and tapered body member encircling area constructed of a relatively soft metal, a triangularly shaped blade secured to the upper portion of said body member encircling area, said blade constructed of a relatively hard metal extending upwards and outwards of the upper portion of said body member enclosing area and terminating downward and outward from said body member enclosing area a spur secured to the underside of said blade and extending in parallel relationship with said blade, a sharpened projection secured to one side of said blade and extending outwardly therefrom, an opening formed at the lower portion of said member enclosing area with means extending therethrough whereby said attachment may be suspended from the body of the user of the attachment when the same is not fitted over the finger or thumb of the user thereof.

2. The structure recited in claim 1 wherein a plurality of perforations are provided in the body of the member encircling area.

* * * * *